US011501712B2

(12) United States Patent
Kim et al.

(10) Patent No.: US 11,501,712 B2
(45) Date of Patent: Nov. 15, 2022

(54) DISPLAY DEVICE AND DRIVING METHOD OF THE DISPLAY DEVICE

(71) Applicant: Samsung Display Co., Ltd., Yongin-si (KR)

(72) Inventors: Eun Ju Kim, Yongin-si (KR); Ji Hyun Ka, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/679,996

(22) Filed: Nov. 11, 2019

(65) Prior Publication Data

US 2020/0302866 A1 Sep. 24, 2020

(30) Foreign Application Priority Data

Mar. 20, 2019 (KR) ..... 10-2019-0032006

(51) Int. Cl.
*G09G 3/3258* (2016.01)

(52) U.S. Cl.
CPC ... *G09G 3/3258* (2013.01); *G09G 2320/0633* (2013.01); *G09G 2330/026* (2013.01)

(58) Field of Classification Search
CPC ..... G09G 3/3258; G09G 3/3225; G09G 2330/026; G09G 2330/028
See application file for complete search history.

(56) References Cited

U.S. PATENT DOCUMENTS

| | | | | |
|---|---|---|---|---|
| 6,795,045 | B2 | 9/2004 | Jang et al. | |
| 8,896,636 | B2 | 11/2014 | Lee et al. | |
| 8,970,642 | B2 | 3/2015 | An et al. | |
| 2013/0127924 | A1* | 5/2013 | Lee | G09G 3/2025 345/82 |
| 2016/0055799 | A1 | 2/2016 | Eom et al. | |
| 2016/0314761 | A1* | 10/2016 | Kim | G09G 5/10 |
| 2017/0103707 | A1* | 4/2017 | Park | G09G 3/2003 |
| 2017/0116920 | A1 | 4/2017 | Kwon et al. | |
| 2019/0206299 | A1* | 7/2019 | Kim | G09G 3/20 |

FOREIGN PATENT DOCUMENTS

| | | | |
|---|---|---|---|
| JP | 2005-91420 | A | 4/2005 |
| KR | 10-0748500 | B1 | 8/2007 |
| KR | 10-1094303 | B1 | 12/2011 |
| KR | 10-2016-0022973 | A | 3/2016 |
| KR | 10-2017-0048630 | A | 5/2017 |
| KR | 10-1966393 | B1 | 4/2019 |

* cited by examiner

*Primary Examiner* — Dennis P Joseph
(74) *Attorney, Agent, or Firm* — Lewis Roca Rothgerber Christie LLP

(57) ABSTRACT

There are provided a display device and a driving method of the display device. The display device includes a display panel including a plurality of pixels, and a controller configured to determine an off ratio corresponding to an initialization driving power voltage of the display panel, and configured to control emission of the plurality of pixels corresponding to the determined off ratio, wherein different initialization driving power voltages are determined based on luminances and chromaticities of a plurality of display panels.

16 Claims, 6 Drawing Sheets

DISPLAY DEVICE AND DRIVING METHOD OF THE DISPLAY DEVICE

CROSS-REFERENCE TO RELATED APPLICATION

The present application claims priority to, and the benefit of, Korean patent application no. 10-2019-0032006, filed in the Korean Intellectual Property Office on Mar. 20, 2019, the entire contents of which is incorporated herein by reference.

BACKGROUND

1. Field

Embodiments of the present disclosure generally relate to a display device, and to a driving method of the display device.

2. Description of the Related Art

In general, a display device includes a plurality of pixels, and each of the pixels has a light emitting device, a pixel circuit configured to independently drive the light emitting device, and a driving control circuit configured to drive the pixel circuit. The pixel circuit uses a driving power voltage to control the light emitting device. The driving power voltage may include a high-potential driving power voltage and a low-potential driving power voltage, and each of the high-potential driving power voltage and the low-potential driving power voltage may be set to a respective level suitable for its purpose.

The driving power voltage is determined according to characteristics of the pixels, and may vary depending on display panels. However, the same value is currently applied to display panels by considering a "worst case" scenario. This may cause inefficiency from the viewpoint of power consumption. A technique for decreasing a ratio of a non-emission period in one frame period may be applied so as to improve efficiency of power consumption, but the decrease in the ratio of the non-emission period may increase an instantaneous afterimage.

SUMMARY

Embodiments provide a display device capable of differentially applying an off ratio, which is a ratio of a non-emission period with respect to a frame period, according to characteristics of a display panel, and a driving method of the display device.

Embodiments also provide a display device capable of applying an off ratio corresponding to an initialization driving power voltage for each display panel, and a driving method of the display device.

In accordance with an aspect of the present disclosure, there is provided a display device including a display panel including a plurality of pixels, and a controller configured to determine an off ratio corresponding to an initialization driving power voltage of the display panel, and configured to control emission of the plurality of pixels corresponding to the determined off ratio, wherein different initialization driving power voltages are determined based on luminances and chromaticities of a plurality of display panels.

The controller may include a driving power voltage determiner configured to determine the initialization driving power voltage of the display panel based on a luminance and a chromaticity of the display panel, and an off ratio determiner configured to determine the off ratio corresponding to the initialization driving power voltage of the display panel.

The off ratio determiner may be configured to increase the off ratio as a low-potential initialization driving power voltage with respect to the plurality of display panels increases.

The driving power voltage determiner may be configured to determine an offset based on a distribution of the initialization driving power voltages with respect to the plurality of display panels, and may be configured to determine a final driving power voltage by reflecting the determined offset to the initialization driving power voltage of the display panel.

The display device may further include a power supply configured to supply power corresponding to the final driving power voltage to the display panel.

The display device may further include an emission driver configured to generate an emission control signal based on the off ratio, and configured to apply the emission control signal to the plurality of pixels.

The emission driver may be configured to apply an emission control signal having a turn-off level to the plurality of pixels during a non-emission period in a frame, which is determined by the off ratio, and is configured to apply an emission control signal having a turn-on level to the plurality of pixels during an emission period in the frame, which is determined by the off ratio.

The initialization driving power voltage of the display panel may be a low-potential driving power voltage.

In accordance with another aspect of the present disclosure, there is provided a method for driving a display device, the method including determining an initialization driving power voltage based on a luminance and a chromaticity of a display panel including a plurality of pixels, determining an off ratio corresponding to the determined initialization driving power voltage, and controlling emission of the plurality of pixels corresponding to the determined off ratio, wherein different initialization driving power voltages of a plurality of display panels are determined based on luminances and chromaticities of the plurality of display panels.

The determining of the off ratio may include increasing the off ratio as a low-potential initialization driving power voltage of the plurality of display panels increases.

The method may further include determining an offset based on a distribution of the initialization driving power voltages of the plurality of display panels, determining a final driving power voltage by reflecting the determined offset to the determined initialization driving power voltage, and supplying power corresponding to the final driving power voltage to the display panel.

The controlling of the emission of the plurality of pixels may include generating an emission control signal based on the off ratio, and applying the emission control signal to the plurality of pixels.

The applying of the emission control signal may include applying an emission control signal having a turn-off level to the plurality of pixels during a non-emission period in a frame, which is determined by the off ratio, and applying an emission control signal having a turn-on level to the plurality of pixels during an emission period in the frame, which is determined by the off ratio.

In accordance with still another aspect of the present disclosure, there is provided a method for driving a display device, the method including determining initialization driving power voltages of a plurality of display panels based on luminances and chromaticities of the plurality of display panels, determining a common driving power voltage with respect to the plurality of display panels based on a distribution of the initialization driving power voltages of the plurality of display panels, and setting an off ratio with respect to each of the plurality of display panels based on a respective difference between the common driving power voltage and the initialization driving power voltages of the plurality of display panels.

The common driving power voltage may be determined as a lowest value of the initialization driving power voltages of the plurality of display panels.

The luminances and the chromaticities may be determined by at least one of a sample of a light emitting device provided in each of the display panels, a respective kind of the display panels, a respective specification of the display panels, and a respective size of the display panels.

The off ratio may be set to control lengths of an emission period and a non-emission period in a frame with respect to each of the plurality of display panels while being driven by receiving the common driving power voltage.

The common driving power voltage may be a low-potential driving power voltage.

The setting of the off ratio of each of the plurality of display panels may be performed before the display panel is initially driven.

DETAILED DESCRIPTION

Figure 1:
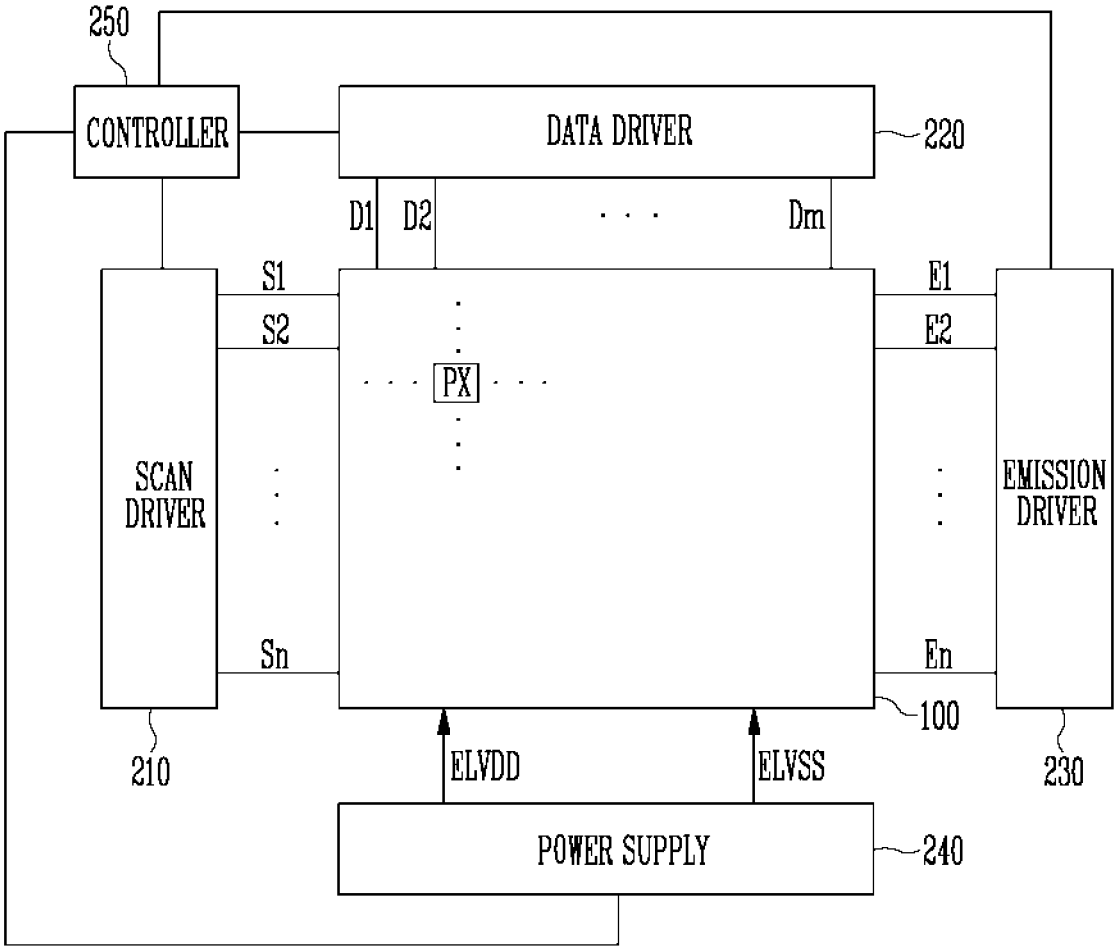
FIG. 1 is a block diagram illustrating a display device in accordance with an embodiment of the present disclosure.

Hereinafter, embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described or shown in the figures. Unless otherwise noted, like reference numerals denote like elements throughout the attached drawings and the written description, and thus, descriptions thereof may not be repeated. In the drawings, the relative sizes of elements, layers, and regions may be exaggerated for clarity.

It will be understood that, although the terms "first," "second," "third," etc., may be used herein to describe various elements, components, regions, layers, and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the terms "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." In addition, the use of alternative language, such as "or," when describing embodiments of the present invention, refers to "one or more embodiments of the present invention" for each corresponding item listed. As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device in accordance with an embodiment of the present disclosure.

Referring to FIG. 1, the display device in accordance with the embodiment of the present disclosure may include a display panel 100 including a plurality of pixels PX, a scan driver 210, a data driver 220, an emission driver 230, a power supply 240, and a controller 250.

The controller 250 may generate a scan driving control signal, a data driving control signal, an emission driving control signal, and a power driving control signal, based on externally supplied signals (e.g., signals input from the outside). The scan driving control signal generated by the controller 250 may be supplied to the scan driver 210, the data driving control signal generated by the controller 250 may be supplied to the data driver 220, the emission driving control signal generated by the controller 250 may be supplied to the emission driver 230, and the power driving control signal generated by the controller 250 may be supplied to the power supply 240.

The scan driving control signal may include a plurality of clock signals and a scan start signal. The scan start signal may control an output timing of a first scan signal. The clock signals may be used to shift the scan start signal.

The data driving control signal may include a source start pulse and clock signals. The source start pulse may control a sampling start time of data, and the clock signals may be used to control a sampling operation.

The emission driving control signal may include an emission start pulse and clock signals. The emission start pulse may control a first timing of an emission control signal. The clock signals may be used to shift the emission start pulse.

The scan driver 210 may output a scan signal corresponding to the scan driving control signal. The scan driver 210 may sequentially supply the scan signal to scan lines S1 to Sn. The scan signal may be set to a gate-on voltage (e.g., a high-level voltage) at which transistors included in the pixels PX can be turned on.

The data driver 220 may supply a data signal to data lines D1 to Dm, corresponding to the data driving control signal. The data signal supplied to the data lines D1 to Dm may be supplied to pixels PX to which the scan signal is supplied. To this end, the data driver 220 may supply the data signal to the data lines D1 to Dm to be synchronized with the scan signal.

The emission driver 230 may supply an emission control signal to emission control lines E1 to En corresponding to the emission driving control signal. The emission control signal may be used to control an emission time of the pixels PX. For example, a given pixel PX that is supplied with the emission control signal may be set to an emission state during a period in which the emission control signal is supplied (e.g., during a period in which an emission control signal having a turn-on level is supplied), and may be set to a non-emission state during another period (e.g., during a period in which an emission control signal having a turn-off level is supplied). Hereinafter, the period in which the pixels PX are set to the emission state by the emission control signal is referred to as an emission period, and the period in which the pixels PX are set to the non-emission state is referred to as a non-emission period.

In various embodiments of the present disclosure, an Off Ratio (OR), which is a ratio of the non-emission period with respect to one frame period, may be determined corresponding to an initialization driving power voltage of the display panel 100. For example, the OR may be an Active Matrix Organic Light Emitting Diode (AMOLED) Impulse Driving (AID) Off Ratio (AOR). A supply period of the emission control signal in one frame period may be controlled according to the determined OR.

The emission driver 230 may supply the emission control signal having the turn-on level during the emission period, and may output the emission control signal having the turn-off level during the non-emission period, corresponding to the OR defined by the emission driving control signal. A method in which the emission driver 230 in accordance with the present disclosure supplies the emission control signal according to the OR will be described in more detail with reference to FIGS. 4 to 8.

The power supply 240 may supply a driving power voltage to each of the pixels PX included in the display panel 100 based on the power driving control signal. For example, the power supply 240 may supply a first driving power voltage ELVDD and a second driving power voltage ELVSS to the display panel 100. The first driving power voltage ELVDD may be set to a high-potential voltage, and the second driving power voltage ELVSS may be set to a low-potential voltage.

In various embodiments of the present disclosure, the driving power voltage supplied by the power supply 240 may be determined as an initialization driving power voltage. The initialization driving power voltage may be determined by a luminance and a chromaticity of a light emitting device provided in each of the pixels PX. The driving power voltage may be finally determined by applying an offset (e.g., a predetermined offset) to the initialization driving power voltage in consideration of a lowest value of the initialization driving power voltage (e.g., a common driving power voltage), which may be determined with respect to various display panels 100.

The controller 250 may transfer, to the power supply 240, the power driving control signal including information on a level of the driving power voltage, which may be determined as described above. The power supply 240 may generate a driving power voltage having the level determined based on the power driving control signal, and may supply the generated driving power voltage to the display panel 100. A method for determining a driving power voltage will be described in more detail with reference to FIGS. 5 and 6.

The display panel 100 may include a plurality of pixels PX coupled to the data lines D1 to Dm, the scan lines S1 to Sn, and the emission control lines E1 to En. Each of the pixels PX may be supplied with a data signal from a respective one of the data lines D1 to Dm, which is coupled thereto, when a scan signal is supplied from a respective one of the scan lines S1 to Sn, which is also coupled thereto. The pixel PX supplied with the data signal may control an amount of current flowing from the first driving power voltage ELVDD to the second driving power voltage ELVSS via a light emitting device in accordance with the data signal. The light emitting device may generate light (e.g., light with a predetermined luminance) corresponding to the amount of current.

Figure 2:
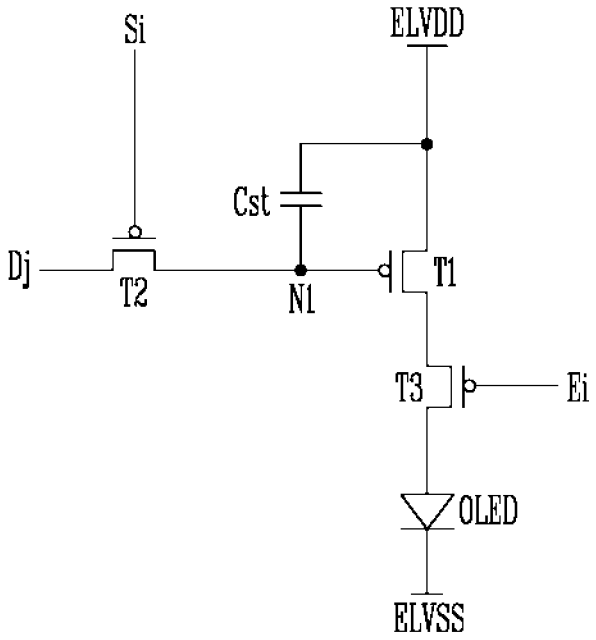
FIG. 2 is a diagram illustrating an embodiment of a pixel shown in FIG. 1.
Figure 3:
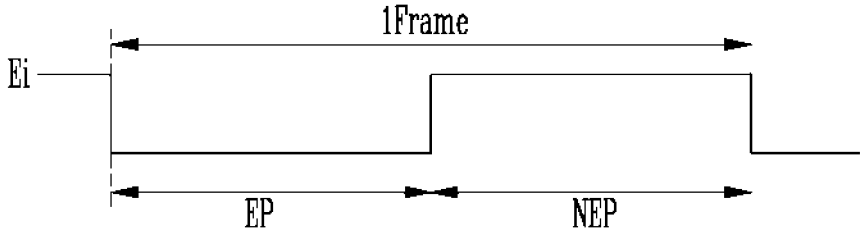
FIG. 3 is a diagram illustrating an example of an emission period and a non-emission period in one frame period.

FIG. 2 is a diagram illustrating an embodiment of the pixel shown in FIG. 1, and FIG. 3 is a diagram illustrating an example of an emission period and a non-emission period in one frame period. For convenience of description, a pixel PX coupled to an ith scan line Si, a jth data line Dj, and an ith emission control line Ei is illustrated in FIG. 2.

Referring to FIG. 2, the pixel PX in accordance with the embodiment of the present disclosure may include first to third transistors T1, T2, and T3, a storage capacitor Cst, and a light emitting device OLED.

The first transistor (driving transistor) T1 is coupled between the first driving power voltage ELVDD and the third transistor T3. A gate electrode of the first transistor T1 is coupled to a first node N1. The first transistor T1 may be turned on corresponding to a voltage of the first node N1. When the first transistor T1 is turned on, a driving current may flow from the first driving power voltage ELVDD to the light emitting device OLED via the third transistor T3 in accordance with a voltage stored in the storage capacitor Cst.

The second transistor (switching transistor) T2 is coupled between the data line Dj and the first node N1. A gate electrode of the second transistor T2 is coupled to the scan line Si. The second transistor T2 may be turned on when a scan signal having a turn-on level is supplied to the scan line Si to thereby supply a data signal supplied to the data line Dj to the first node N1.

The third transistor (emission control transistor) T3 is coupled between the first transistor T1 and the light emitting device OLED. A gate electrode of the third transistor T3 is coupled to the emission control line Ei. The third transistor T3 may be turned on when an emission control signal having a turn-on level is supplied to the emission control line Ei to thereby selectively supply the driving current supplied from the first transistor T1 to the light emitting device OLED.

The storage capacitor Cst is coupled between the first node N1 and the first driving power voltage ELVDD. When a data signal is supplied to the first node N1 via the second transistor T2, the storage capacitor Cst may store a voltage corresponding to the data signal.

A first electrode of the light emitting device OLED is coupled to the third transistor T3, and a second electrode of the light emitting device OLED is coupled to the second driving power voltage ELVSS. The first electrode may be an anode electrode, and the second electrode may be a cathode electrode. The light emitting device OLED may generate light (e.g., light with a predetermined luminance) corresponding to the amount of driving current flowing from the first driving power voltage ELVDD to the second driving power voltage ELVSS via the first transistor T1 and the third transistor T3 in response to an amount of the driving current.

In the embodiment shown in FIG. 2, the transistors T1 to T3 constituting the pixel PX may be implemented with a PMOS transistor. However, in various embodiments, at least some of the transistors T1 to T3 may be implemented with an NMOS transistor, and correspondingly, a pixel circuit may be variously modified.

Although an example of a pixel structure is illustrated in FIG. 2, the pixel PX of the display device in accordance with the embodiment of the present disclosure is not limited to the pixel structure shown in FIG. 2, and may have various structures.

In various embodiments of the present disclosure, an emission control signal supplied to the emission control line Ei in one frame period has a turn-on level during an emission period EP, and has a turn-off level during a non-emission period NEP, as shown in FIG. 3. In the embodiment shown in FIG. 3, the turn-on level of the emission control signal is set to a low level so as to turn on the third transistor T3 implemented as a PMOS transistor. Accordingly, the turn-off level of the emission control signal is set to a high level.

During the emission period EP, when the third transistor T3 is turned on, a current path is formed from the first driving power voltage ELVDD to the second driving power voltage ELVSS through the light emitting device OLED so that the light emitting device OLED emits light. During the non-emission period NEP, when the third transistor T3 is turned off, the current path from the first driving power voltage ELVDD to the second driving power voltage ELVSS is interrupted so that the light emitting device OLED does not emit light.

In various embodiments of the present disclosure, a ratio of the non-emission period NEP with respect to one frame (e.g., an OR) may be determined corresponding to an initialization driving voltage. For example, the OR may be determined based on an initialization low-potential driving power voltage.

In various embodiments of the present disclosure, the initialization low-potential driving power voltage may be determined according to a luminance and a chromaticity of the display panel 100. In addition, a final low-potential driving power voltage may be determined by applying an offset determined by Multi-Time Programming (MTP) to the initialization low-potential driving power voltage.

A method for determining the driving power voltage in accordance with the present disclosure will be described in more detail below.

Figure 4:
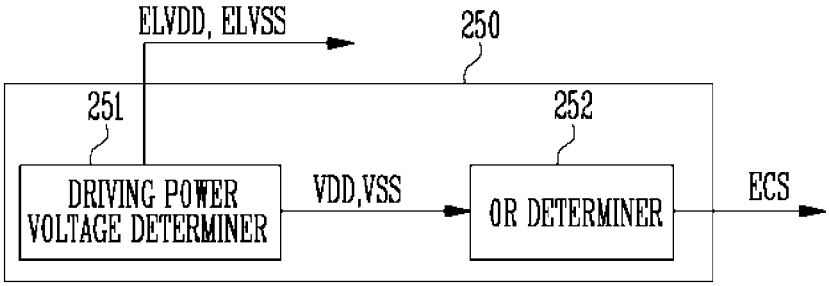
FIG. 4 is a block diagram illustrating a detailed configuration of a controller shown in FIG. 1.
Figure 5:
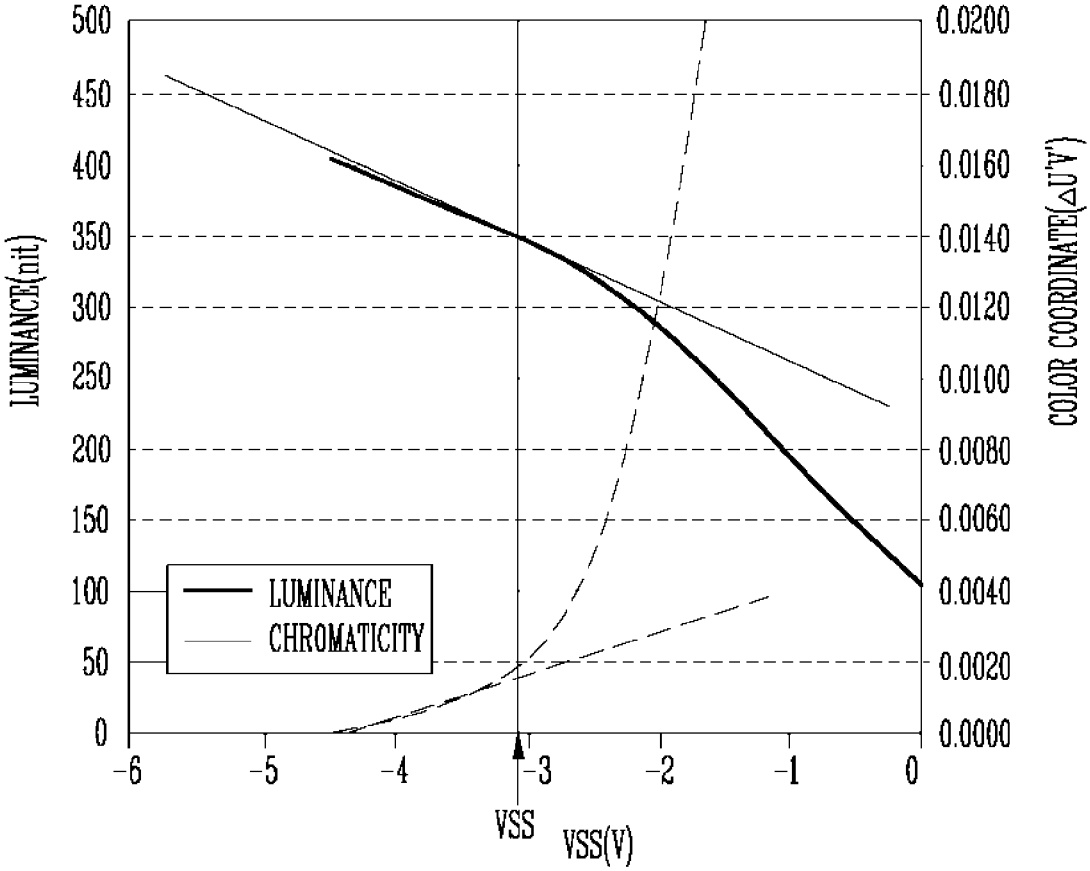
FIGS. 5 and 6 are graphs illustrating a method for determining a driving power voltage in accordance with the present disclosure.
Figure 6:
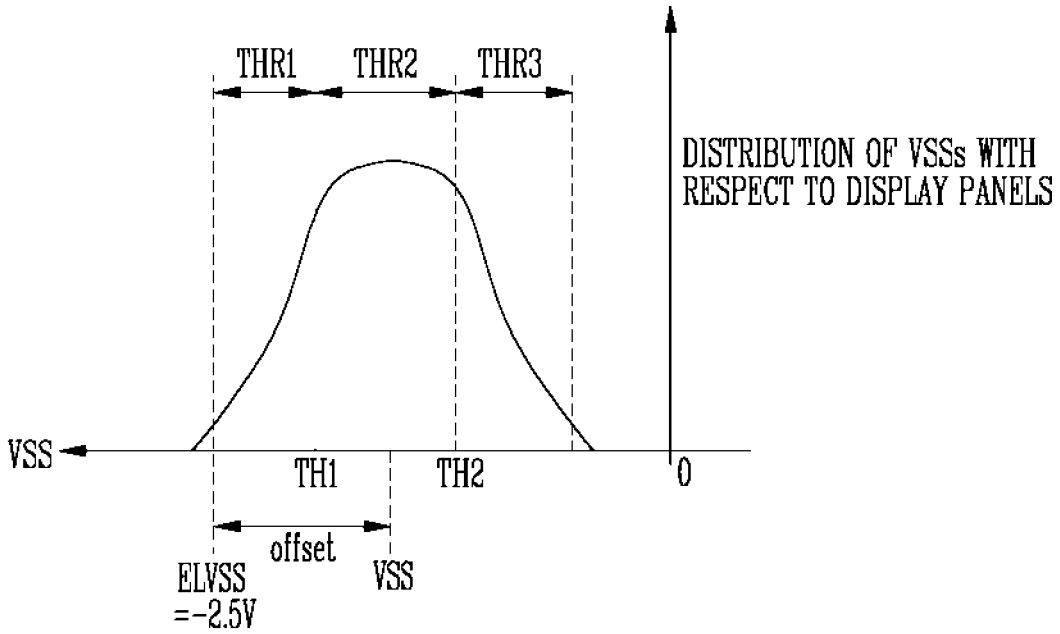
Figure 7:
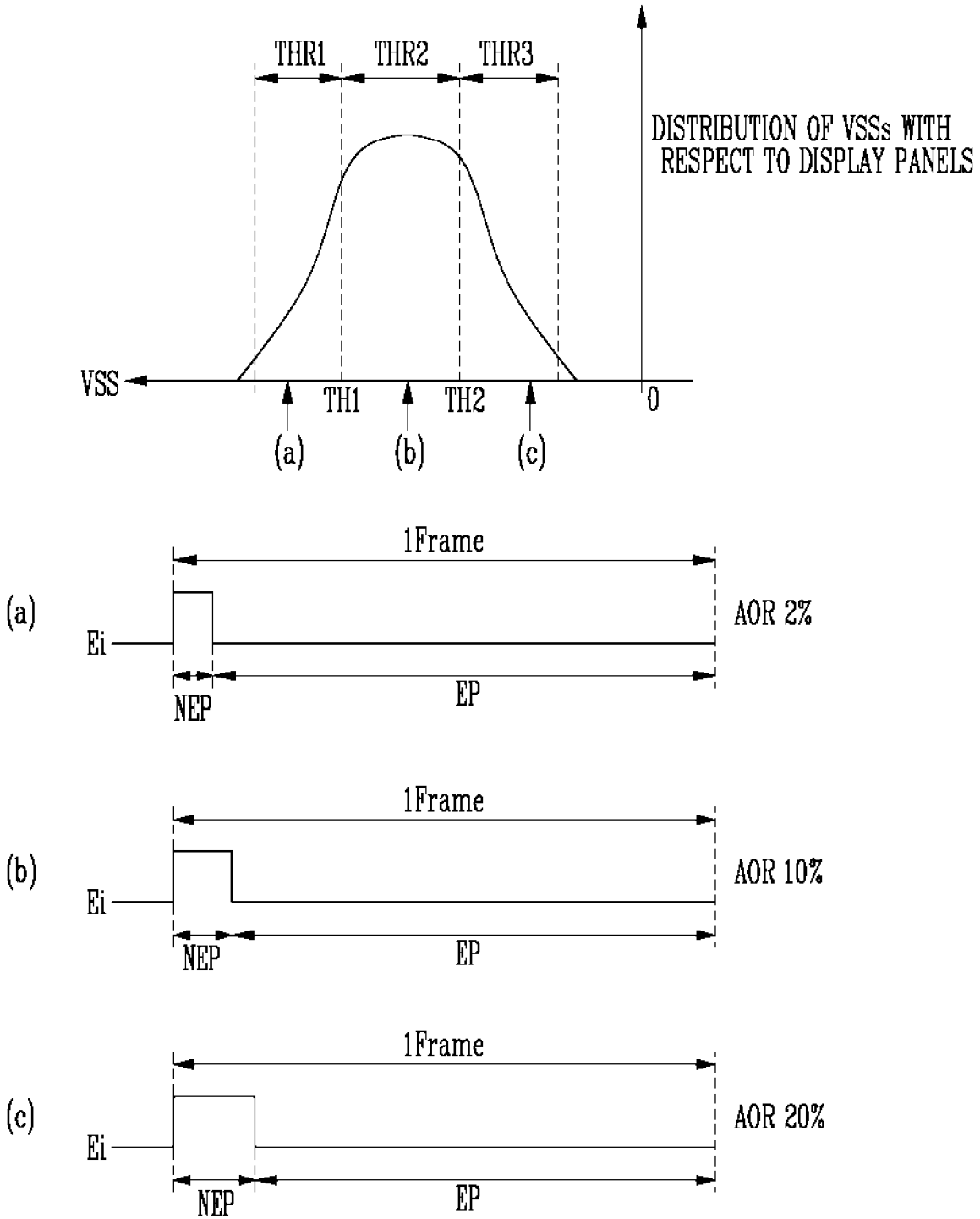
FIG. 7 is a graph illustrating off ratios in accordance with embodiments of the present disclosure.

FIG. 4 is a block diagram illustrating a detailed configuration of the controller shown in FIG. 1, FIGS. 5 and 6 are graphs illustrating a method for determining a driving power voltage in accordance with the present disclosure, and FIG. 7 is a graph illustrating ORs in accordance with embodiments of the present disclosure.

Referring to FIG. 4, the controller 250 of the display device in accordance with the embodiment of the present disclosure may include a driving power voltage determiner 251 and an OR determiner 252.

The driving power voltage determiner 251 may determine initialization driving power voltages VDD and VSS based on a luminance and a chromaticity of the display panel 100, and may determine final driving power voltages ELVDD and ELVSS by reflecting an offset (e.g., a predetermined offset) to the determined initialization driving power voltages VDD and VSS.

For example, the driving power voltage determiner 251 may set initialization driving power voltages VDD and VSS of the display panel 100. The initialization driving power voltages VDD and VSS may include a first initialization driving power voltage VDD and a second initialization driving power voltage VSS. The first initialization driving power voltage VDD may be a high-potential initialization driving power voltage, and the second initialization driving power voltage VSS may be a low-potential initialization driving power voltage.

The initialization driving power voltages VDD and VSS may be determined based on the luminance and chromaticity of the display panel 100. The luminance and chromaticity of the display panel 100 may be determined by a sample of a light emitting device OLED provided in the display panel 100, a kind of the display panel 100, a specification of the display panel 100, a size of the display panel 100, etc. When the luminance and chromaticity of the display panel 100 are determined, the initialization driving power voltages VDD and VSS may be determined based on luminance and chromaticity curves shown in FIG. 5.

When the initialization driving power voltages VDD and VSS are determined, the driving power voltage determiner 251 may determine final driving power voltages ELVDD and ELVSS by applying an offset (e.g., a predetermined offset) to the initialization driving power voltages VDD and VSS.

For example, as shown in FIG. 6, the driving power voltage determiner 251 may determine an offset with respect to second initialization driving power voltages VSS determined with respect to various display panels 100 by considering a lowest value of the second initialization driving power voltages VSS. In FIG. 6, a distribution of second initialization driving power voltages VSS with respect to display panels 100 is shown. Because some display panels 100 that are manufactured according to the same specification are produced using the same material through the same process, the display panels 100 have the same panel characteristic. Accordingly, the display panels 100 are to have the same second initialization driving power voltage VSS. However, some display panels 100 may have substantially different second initialization driving power voltages VSS due to different processes and designs thereof. Accordingly, the second initialization driving power voltages VSS of the display panels 100 may have a Gaussian distribution, as shown in FIG. 6.

The second initialization driving power voltages VSS with respect to all of the display panels 100 may be actually used as the second driving power voltage ELVSS. However, for convenience of mass production, the second driving power voltage ELVSS of the display panels 100 may be set as the lowest value (e.g., −2.5V in FIG. 6) of the second initialization driving power voltages VSS with respect to the display panels 100.

In an embodiment, the offset may correspond to the difference between a lowest value of second initialization driving power voltages VSS with respect to various display panels 100 (e.g. a common driving power voltage) and a second initialization driving power voltage VSS that is determined as described above with respect to a corresponding display panel 100. Accordingly, the driving power voltage determiner 251 may determine the second driving power voltage ELVSS by reflecting (e.g., subtracting) the determined offset to the second initialization power voltage VSS.

The first driving power voltage ELVDD may be determined by considering the offset as described above, or may be determined corresponding to a second driving power voltage ELVSS (e.g., a predetermined second driving power voltage ELVSS). For example, the driving power voltage determiner 251 may determine the first driving power voltage ELVDD by identically applying the offset determined with respect to the second initialization driving power voltage VSS to the first initialization driving power voltage VDD.

The driving power voltage determiner 251 may transfer the initialization driving power voltages VDD and VSS determined as described above to the OR determiner 252. For example, the driving power voltage determiner 251 may transfer the second initialization driving power voltage VSS to the OR determiner 252.

Also, the driving power voltage determiner 251 may transfer the determined driving power voltage to the power supply 240 to thereby enable the driving power voltage to be supplied to the display panel 100.

The OR determiner 252 may determine an OR corresponding to the initialization driving power voltages VDD and VSS transferred from the driving power voltage determiner 251, and may control the emission driver 230 to emit an emission control signal corresponding to the determined OR. For example, the OR determiner 252 may generate an emission driving control signal ECS corresponding to the determined OR, and may transfer the emission driving control signal ECS to the emission driver 230.

In an embodiment, the OR determiner 252 may determine an OR corresponding to the second initialization driving power voltage VSS. For example, the OR determiner 252 may determine a threshold range belonging to the second initialization driving power voltage VSS by comparing the second initialization driving power voltage VSS with threshold values (e.g., predetermined threshold values).

The OR determiner 252 may load an OR (e.g., a predetermined OR) corresponding to the threshold range to which the second initialization driving power voltage VSS belongs. In an embodiment, the OR determiner 252 may load an OR (e.g., a predetermined OR) using a Look Up Table (LUT), or the like, which maps and stores ORs corresponding to threshold ranges with respect to the second initialization driving power voltage VSS.

For example, referring to FIG. 7, when the second initialization driving power voltage VSS is smaller than a first threshold value TH1 (e.g., when the second initialization driving power voltage VSS belongs to a first threshold range THR1), the OR determiner 252 may determine the OR as a first value. In addition, when the second initialization driving power voltage VSS is greater than or equal to the first threshold range TH1, and is smaller than a second threshold value TH2 (e.g., when the second initialization driving power voltage VSS belongs to a second threshold range THR2), the OR determiner 252 may determine the OR as a second value. In addition, when the second initialization driving power voltage VSS is greater than or equal to the second threshold value TH2 (e.g., when the second initialization driving power voltage VSS belongs to a third threshold range THR3), the OR determiner 252 may determine the OR as a third value.

In various embodiments, the first value may be smaller than the second value, and the second value may be smaller than the third value. For example, the first value may be 2%, the second value may be 10%, and the third value may be 20%. However, in the present disclosure, the first to third values are not limited to the above-described example.

In FIG. 7, the ORs in accordance with the above-described embodiments are illustrated. That is, when the second initialization driving power voltage VSS belongs to the first threshold range THR1, the OR may be set to 2%, as shown in (a) of FIG. 7.

In addition, when the initialization driving power voltage VSS belongs to the second threshold range THR2, the OR may be set to 10%, as shown in (b) of FIG. 7.

In addition, when the second initialization driving power voltage VSS belongs to the third threshold range THR3, the OR may be set to 20%, as shown in (c) of FIG. 7.

Referring to FIG. 7, the OR increases as the second driving power voltage VSS increases, and a non-emission period NEP in one frame period increases as the OR increases. On the contrary, an emission period EP in the one frame period decreases as the OR increases. In other words, in the present disclosure, the OR increases as the offset of the second initialization driving power voltage VSS determined with respect to the display panel 100 increases.

As described above, because the initialization driving power voltage is determined according to the luminance and chromaticity of the display panel 100, different initialization driving power voltages may be determined with respect to display panels 100. In addition, because the OR is determined corresponding to the initialization driving power voltage, different ORs may be set based on characteristics of the display panels 100. Thus, in the display device in accordance with embodiments of the present disclosure, different respective ORs are applied to the display panels 100. Accordingly, power consumption of the display panel 100 can be reduced, and an instantaneous afterimage can be reduced or minimized.

Figure 8:
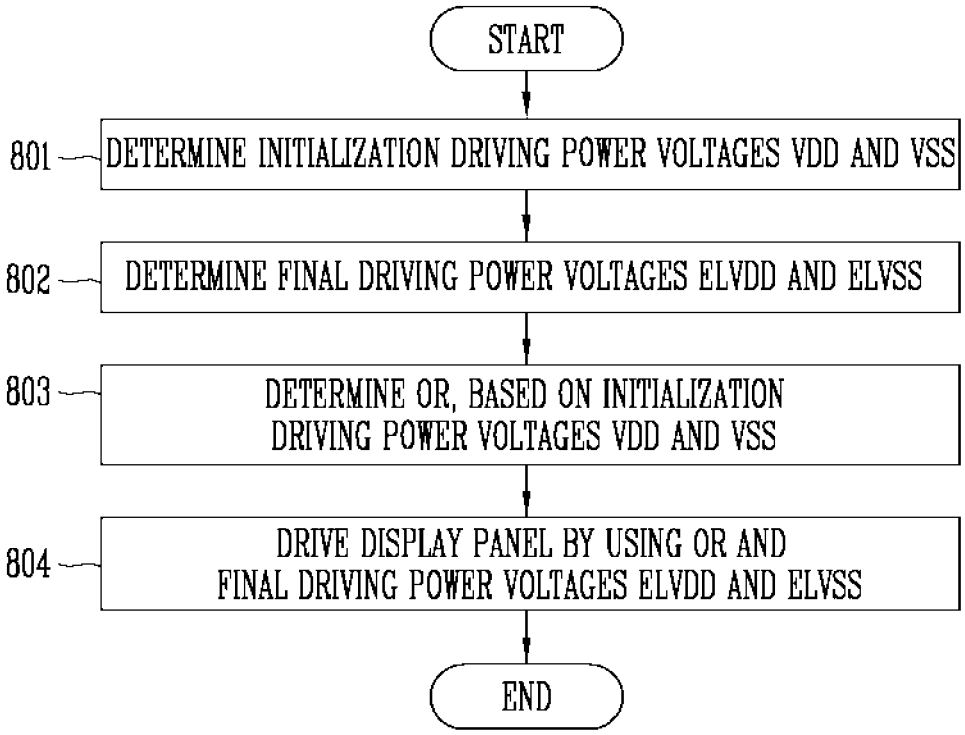
FIG. 8 is a flowchart illustrating a driving method of the display device in accordance with the present disclosure.

FIG. 8 is a flowchart illustrating a driving method of the display device in accordance with the present disclosure.

Referring to FIG. 8, first, the display device in accordance with the present disclosure may determine initialization driving power voltages VDD and VSS (801).

The initialization driving power voltages VDD and VSS may include a first initialization driving power voltage VDD and a second initialization driving power voltage VSS. The first initialization driving power voltage VDD may be a high-potential initialization driving power voltage, and the second initialization driving power voltage VSS may be a low-potential initialization driving power voltage.

The initialization driving power voltages VDD and VSS may be determined based on a luminance and a chromaticity of the display panel 100. The luminance and chromaticity of the display panel 100 may be determined by a sample of a light emitting device OLED provided in the display panel 100, a kind of the display panel 100, a specification of the display panel 100, a size of the display panel 100, etc. When the luminance and chromaticity of the display panel 100 are determined, the initialization driving power voltages VDD and VSS may be determined based on the luminance and chromaticity curves shown in FIG. 5.

Subsequently, the display device may determine final driving power voltages ELVDD and ELVSS by applying an offset (e.g., a predetermined offset) to the initialization driving power voltages VDD and VSS (802). In an embodiment, the display device may determine an offset with respect to the display panel 100 based on a lowest value of second initialization driving power voltages VSS with respect to various display panels 100 (e.g. a common driving power voltage), and may determine final driving power voltages ELVDD and ELVSS by applying the determined offset to the initialization driving power voltages VDD and VSS.

Also, the display device may determine an OR of the display panel 100 based on the initialization driving power voltages VDD and VSS (803). For example, the display device may determine a threshold range to which the second initialization driving voltage VSS belongs by comparing the second initialization driving power voltage VSS with threshold values (e.g., predetermined threshold values). Also, the display device may determine an OR (e.g., a predetermined OR) corresponding to the threshold range to which the second initialization driving voltage VSS belongs. The display device may increase the OR as the low-potential initialization driving power voltage increases.

Subsequently, the display device may drive the display panel 100 by using the determined final driving power voltages ELVDD and ELVSS and the determined OR (804).

Meanwhile, the technical scope of the present disclosure, in which a case where the display device determines the OR after the display device determines the driving power voltages ELVDD and ELVSS of the display panel 100, as illustrated in FIG. 8, is not limited thereto. That is, in various embodiments, the display device may first determine the OR from the initialization driving power voltages VDD and VSS, and may then determine the driving power voltages ELVDD and ELVSS. Alternatively, in various embodiments, the display device may process in parallel the determination of the OR and the determination of the driving power voltages ELVDD and ELVSS.

In various embodiments, the initialization driving power voltage and/or the driving power voltages ELVDD and ELVSS with respect to the display panel 100 may be determined and stored in advance of the manufacturing of the display device, etc., or may be received from the outside. Therefore, an operation in which the display device sets the initialization driving power voltage and/or the driving power voltages ELVDD and ELVSS may be omitted, and the display device may determine the OR based on the initialization driving power voltages VDD and VSS that are stored in advance, or that are received from the outside as described above.

In various embodiments, the method for determining the OR in accordance with the present disclosure may be performed by an apparatus (e.g., an experimental apparatus, a host apparatus, or the like) provided at the outside of the display device (e.g., an external apparatus). Therefore, the controller 250 of the display device may receive an OR set from the outside, and may control the emission driver 230 to output an emission control signal corresponding to the received OR.

In various embodiments, the method for determining the OR in accordance with the present disclosure may be performed at least once before an initialization emission period of the display device (e.g., before product sale). Alternatively, in various embodiments, the method for determining the OR in accordance with the present disclosure may be performed at least once after driving power is supplied to the display device (e.g., after power is on). Alternatively, in various embodiments, the method for determining the OR in accordance with the present disclosure may be performed at least once during a vertical blank period in one frame.

In the display device and the driving method thereof in accordance with the present disclosure, an OR is differentially applied according to an initialization driving power voltage of the display panel. Accordingly, power consumption of display panel can be reduced, and an instantaneous afterimage can be reduced or minimized.

Embodiments have been disclosed herein, and although specific terms are employed, they are used and are to be interpreted in a generic and descriptive sense only, and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise For example indicated. Accordingly, it will be understood by those of skill in the art that various changes in form and details may be made without departing from the spirit and scope of the present disclosure as set forth in the following claims, with functional equivalents thereof to be included therein.

What is claimed is:

1. A display device comprising:

a display panel comprising a plurality of pixels;

a controller configured to:

determine and set an initialization driving power voltage of the display panel based on a luminance and a chromaticity of the display panel, wherein a distribution of initialization driving power voltages is determined based on luminances and chromaticities of a plurality of display panels;

set an off ratio based on the initialization driving power voltage of the display panel after the initialization driving power voltage is set;

control emission of the plurality of pixels corresponding to the off ratio; and determine final driving power voltages of the display panel based on an offset of the initialization driving power voltage from a center of the distribution of the initialization driving power voltages; and an emission driver configured to generate an emission control signal based on the off ratio and configured to apply the emission control signal to the plurality of pixels, wherein the off ratio is equal to a ratio of a period in which an emission control signal having a turn-off level is supplied to a frame period, wherein a driving transistor of the plurality of pixels is electrically connected to a high-potential voltage of the final driving power voltages, wherein a cathode of a light emitting device of the plurality of pixels is electrically connected to a low-potential voltage of the final driving power voltages, and wherein the off ratio increases as the offset of the initialization driving power voltage increases.

2. The display device of claim 1, wherein the controller comprises:

a driving power voltage determiner configured to determine the initialization driving power voltage of the display panel; and an off ratio determiner configured to determine the off ratio corresponding to the initialization driving power voltage of the display panel.

3. The display device of claim 2, wherein the off ratio determiner is configured to increase the off ratio as a low-potential initialization driving power voltage with respect to the plurality of display panels increases.

4. The display device of claim 2, wherein the driving power voltage determiner is configured to determine the offset, and is configured to determine the final driving power voltages by reflecting the offset to the initialization driving power voltage of the display panel.

5. The display device of claim 4, further comprising a power supply configured to supply power corresponding to the final driving power voltages to the display panel.

6. The display device of claim 1, wherein the emission driver is configured to apply the emission control signal having the turn-off level to the plurality of pixels during a non-emission period in a frame, which is determined by the off ratio, and is configured to apply an emission control signal having a turn-on level to the plurality of pixels during an emission period in the frame, which is determined by the off ratio.

7. The display device of claim 1, wherein the initialization driving power voltage of the display panel is a low-potential driving power voltage.

8. A method for driving a display device, the method comprising:

determining and setting an initialization driving power voltage based on a luminance and a chromaticity of a display panel comprising a plurality of pixels, wherein a distribution of initialization driving power voltages is determined based on luminances and chromaticities of a plurality of display panels;

setting an off ratio based on the initialization driving power voltage after setting the initialization driving power voltage;

controlling emission of the plurality of pixels corresponding to the off ratio;

determining final driving power voltages of the display panel based on an offset of the initialization driving power voltage from a center of the distribution of the initialization driving power voltages;

generating an emission control signal based on the off ratio;

applying the emission control signal to the plurality of pixels;

supplying a high-potential voltage of the final driving power voltages to a driving transistor of the plurality of pixels; and supplying a low-potential voltage of the final driving power voltages to a cathode of a light emitting device of the plurality of pixels, wherein the off ratio is equal to a ratio of a period in which an emission control signal having a turn-off level is supplied to a frame period, and wherein the off ratio increases as the offset of the initialization driving power voltage increases.

9. The method of claim 8, wherein the setting of the off ratio comprises increasing the off ratio as a low-potential initialization driving power voltage of the plurality of display panels increases.

10. The method of claim 8, further comprising:

determining the final driving power voltages by reflecting the offset to the initialization driving power voltage; and supplying power corresponding to the final driving power voltages to the display panel.

11. The method of claim 8, wherein the applying of the emission control signal comprises:

applying the emission control signal having the turn-off level to the plurality of pixels during a non-emission period in a frame, which is determined by the off ratio; and applying an emission control signal having a turn-on level to the plurality of pixels during an emission period in the frame, which is determined by the off ratio.

12. A method for driving a display device, the method comprising:

determining and setting initialization driving power voltages of a plurality of display panels based on luminances and chromaticities of the plurality of display panels comprising a plurality of pixels;

determining a common driving power voltage with respect to the plurality of display panels based on a distribution of the initialization driving power voltages of the plurality of display panels;

setting an off ratio with respect to each of the plurality of display panels based on a respective difference between the common driving power voltage and the initialization driving power voltages of the plurality of display panels after setting the initialization driving power voltages;

determining final driving power voltages of each of the plurality of display panels based on an offset of the initialization driving power voltage from a center of the distribution of the initialization driving power voltages;

generating an emission control signal with respect to each of the plurality of display panels based on the off ratio;

applying the emission control signal to the plurality of pixels;

supplying a high-potential voltage of the final driving power voltages to a driving transistor of the plurality of pixels; and supplying a low-potential voltage of the final driving power voltages to a cathode of a light emitting device of the plurality of pixels, wherein the off ratio is equal to a ratio of a period in which an emission control signal having a turn-off level is supplied to a frame period, and wherein the off ratio increases as the offset of the initialization driving power voltage increases.

13. The method of claim 12, wherein the common driving power voltage is determined as a lowest value of the initialization driving power voltages of the plurality of display panels.

14. The method of claim 12, wherein the luminances and the chromaticities are determined by at least one of a sample of a light emitting device provided in each of the display panels, a respective kind of the display panels, a respective specification of the display panels, and a respective size of the display panels.

15. The method of claim 12, wherein the common driving power voltage is a low-potential driving power voltage.

16. The method of claim 12, wherein the setting of the off ratio of each of the plurality of display panels is performed before the display panel is initially driven.

* * * * *